US005555929A

United States Patent [19]

Ishikawa

[11] Patent Number: 5,555,929

[45] Date of Patent: Sep. 17, 1996

[54] HEAT EXCHANGER

[75] Inventor: Morio Ishikawa, Nukata-gun, Japan

[73] Assignee: Nippondenso Co., Ltd, Kariya, Japan

[21] Appl. No.: 447,848

[22] Filed: May 23, 1995

[30] Foreign Application Priority Data

May 23, 1994 [JP] Japan ..... 6-108749

[51] Int. Cl.[6] ..... F28F 9/02

[52] U.S. Cl. ..... 165/76; 165/178; 285/189; 285/396

[58] Field of Search ..... 165/76, 178; 285/189, 285/396; 228/135

[56] References Cited

U.S. PATENT DOCUMENTS

| | | | |
|---|---|---|---|
| 7,318 | 4/1850 | Brown | 285/396 |
| 850,070 | 4/1907 | Spikes | 285/396 X |
| 935,000 | 9/1909 | Dehn | 285/396 X |
| 1,319,124 | 10/1919 | Stewart | 228/135 X |
| 3,232,644 | 2/1966 | Pfeifer et al. | 285/194 |
| 4,103,101 | 7/1978 | Maier | 174/65 R |
| 5,163,716 | 11/1992 | Bolton et al. . | |
| 5,228,727 | 7/1993 | Tokutake et al. | 285/189 |

FOREIGN PATENT DOCUMENTS

| | | | |
|---|---|---|---|
| 2588367 | 4/1987 | France | 165/178 |
| 1150294 | 10/1989 | Japan . | |
| 3127885 | 12/1991 | Japan . | |
| 4127410 | 11/1992 | Japan . | |
| 4348020 | 12/1992 | Japan . | |
| 5133489 | 5/1993 | Japan . | |
| 545382 | 6/1993 | Japan . | |

*Primary Examiner*—Allen J. Flanigan
*Attorney, Agent, or Firm*—Cushman, Darby & Cushman

[57] ABSTRACT

A heat exchanger includes a first part made of metallic core material and having a first connecting portion, and a second part made of metallic core material and having a second connecting portion for connection to the first connecting portion. At least one of the first part and second parts is covered with a brazing layer, and the first and second parts are connected to one another by melting the brazing layer after the first part and the second part are assembled. The first connecting portion includes a fitting concave portion, and the second connecting portion includes a fitting convex portion which is press fitted into the fitting concave portion. The first connecting portion and the second connecting portion have the metallic core material exposed to each surface thereof so that each metallic core material directly contacts with one another when the convex portion is fitted in the concave portion. In this way, it is possible to fix the first part with the second part temporarily with a simple method and without more time and expense than needed.

10 Claims, 4 Drawing Sheets

HEAT EXCHANGER

BACKGROUND OF THE INVENTION

1. Field of the Invention

The present invention relates to a heat exchanger which is manufactured by unit brazing.

2. Related Art

For manufacturing a heat exchanger such as a refrigerant evaporator, a refrigerant condenser, a radiator used in a refrigeration cycle by unit brazing, each part is assembled in a certain position (core assembling), and such assembled state should be kept until the brazing has been completed to prevent the parts from dropping off and slipping.

So, in a conventional manufacturing method, the parts which have been assembled are temporarily fixed, for example, the parts are crimped or partially connected together by welding or brazing. The temporary fixation of the parts holds the assembled state of the parts temporarily until the unit-brazing is completed, however, it may require more time and expense than needed.

For example, in the temporary fixation by crimping, a process for deforming a portion of the part and forming a crimped portion is needed. In the temporary fixation by welding, the parts should be heated and a process for supplying welding material is needed. In the temporary fixation by brazing, a process for supplying brazing material is needed. As a conventional pipe connecting structure, two pipes are connected by locking a pin in a keyhole or driving one pipe along a cam face formed on the other pipe (e.g., Japanese Utility Model Applications Laid-Open Nos. 5-45385, 1-150294, etc.).

However, when at least one of two pipes is covered with a clad material for brazing and is heated, such locking may be loosened because the clad material is molten by heating thereby causing a gap in the locking portion. So, it is difficult to perform the brazing and maintain the parts accurately positioned.

SUMMARY OF THE INVENTION

The present invention is made in view of the above problems, and a purpose of the present invention is to provide a heat exchanger capable of being temporarily fixed with a simple method and without more time and expense than needed.

According to the present invention, a heat exchanger includes a first part made of metallic core material and having a first connecting portion, and a second part made of metallic core material and having a second connecting portion which is connected to the first connecting portion. At least one of the first and second parts is covered with a brazing layer, and the first and second parts are connected to one another by melting the brazing layer after the first and second parts are assembled. The first connecting portion includes a fitting concave portion, and the second connecting portion includes a fitting convex portion which is press fitted into the fitting concave portion. The first and second connecting portions have their metallic core material exposed at the surface thereof so that the metallic core material of each directly contacts with one another when the convex and concave portions are fitted together. In this way, the metallic core material of the fitting concave portion and the fitting convex portion directly contact with one another while the fitting convex portion is being fitted in the fitting concave portion. So, the first part and the second part are temporarily fixed while being assembled together. Therefore, it is not necessary to perform a temporary fixation of the first part and second part by crimping, welding or brazing. As a result, it is possible to simplify the process, to shorten the working time for the temporary fixation and to reduce the cost.

BRIEF DESCRIPTION OF THE DRAWINGS

Other objects, features and characteristics of the present invention as well as the functions of related parts will become clear from a study of the following detailed description, the appended claims, and the drawings. In the accompanying drawings:

DETAILED DESCRIPTION OF THE INVENTION

An embodiment of a heat exchanger according to the present invention is described with respect to FIGS. 1–4.

Figure 4:
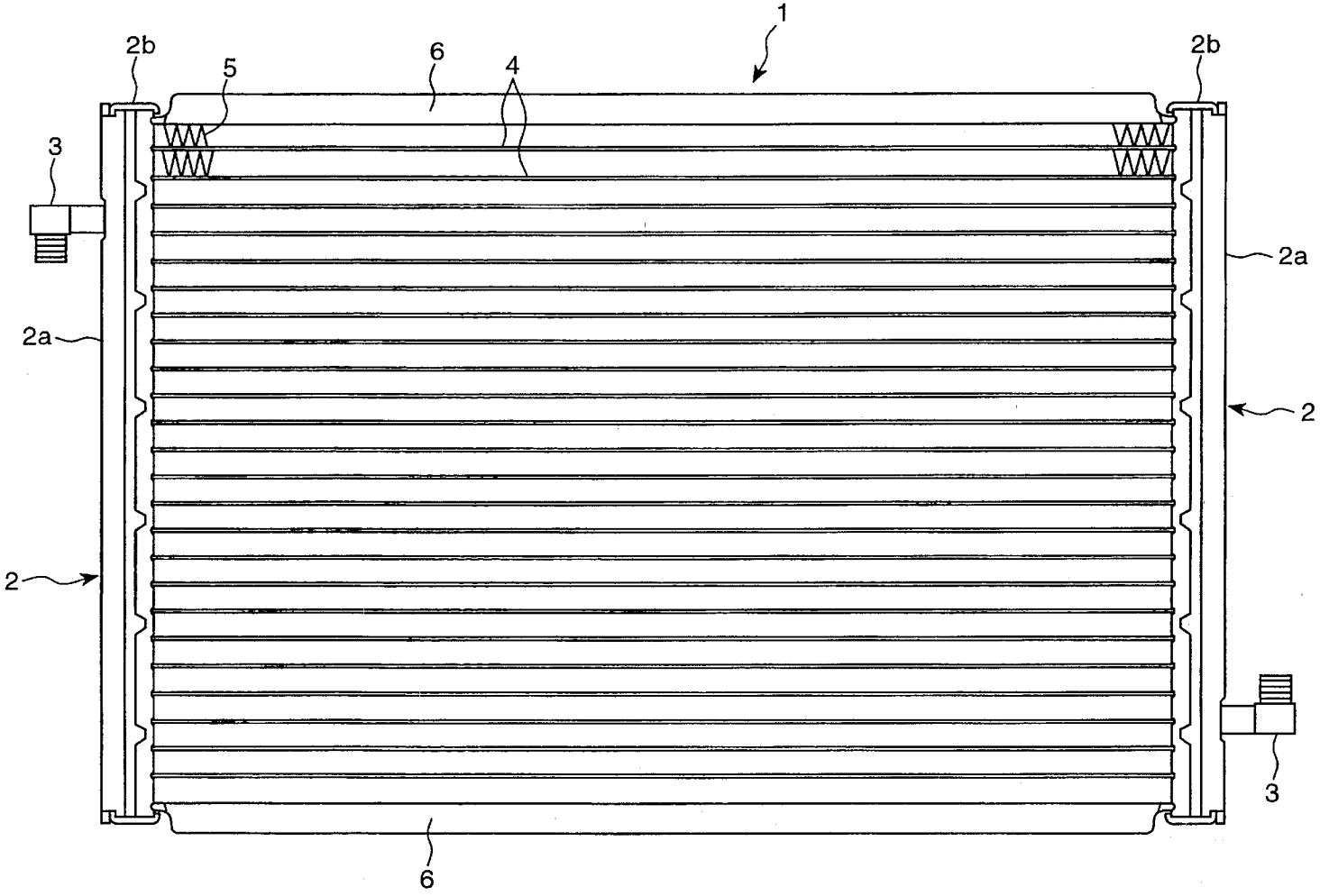
FIG. 4 is an elevational view illustrating a heat exchanger according to the present invention.

In FIG. 4, heat exchanger 1 includes a core which heat exchanges fluid (e.g. refrigerant) with a heat exchanging medium (e.g. air), a pair of headers 2 disposed at opposite sides of the core, and a pair of joint pipes 3 assembled in headers 2. The core includes tubes 4, corrugated fins 5 and side plates 6. Tubes 4 and corrugated fins 5 are assembled alternatively, and side plates 6 are disposed at each side end.

Tubes 4 have a fluid passage therein for passing fluid. Tubes 4 are manufactured from a thick aluminum plate by extruding. Corrugated fins 5 facilitate the heat exchange between fluid passing in tubes 4 and heat exchanging medium passing outside of tubes 4. Corrugated fins 5 are manufactured from a thin aluminum plate into a wave shape by roller forming. A plurality of louvers (not shown) are equipped with corrugated fins 5 to improve heat exchange efficiency.

Header 2 includes a cylindrical pipe body 2*a* and caps 2*b*. Pipe body 2*a* is made of a metallic core material, being manufactured from an aluminum plate, both sides but not the inner surface being clad with brazing material 7 (FIG. 2). Each cap 2*b* closes airtightly an opening of pipe body 2*a* at each side end (FIG. 4). A plurality of long holes (not shown), into which each end portion of tubes 4 is inserted, are provided in an outer wall surface of pipe body 2*a* in a longitudinal direction. In an outer surface of pipe body 2*a* at the side opposite the long holes, an assembling hole 20 (FIG. 1), into which pipe joint 3 is inserted, is provided so as to pass through the wall surface of header 2. Assembling hole 20 is formed by pressing after a flat portion 21 is formed on the outer surface having a curved cross-section. Pipe joint 3 is connected with an inlet pipe (not shown) and an outlet pipe (not shown). Fluid flows into the inlet pipe and out of the outlet pipe. Pipe joint 3 is made of a metallic core material such as aluminum and manufactured by die-cast. A cylindrical portion 30 which is inserted into assembling hole 20 of the header 2 is provided at the side of header 2. Next, the assembling structure of header 2 and pipe joint 3 is described.

Figure 1:
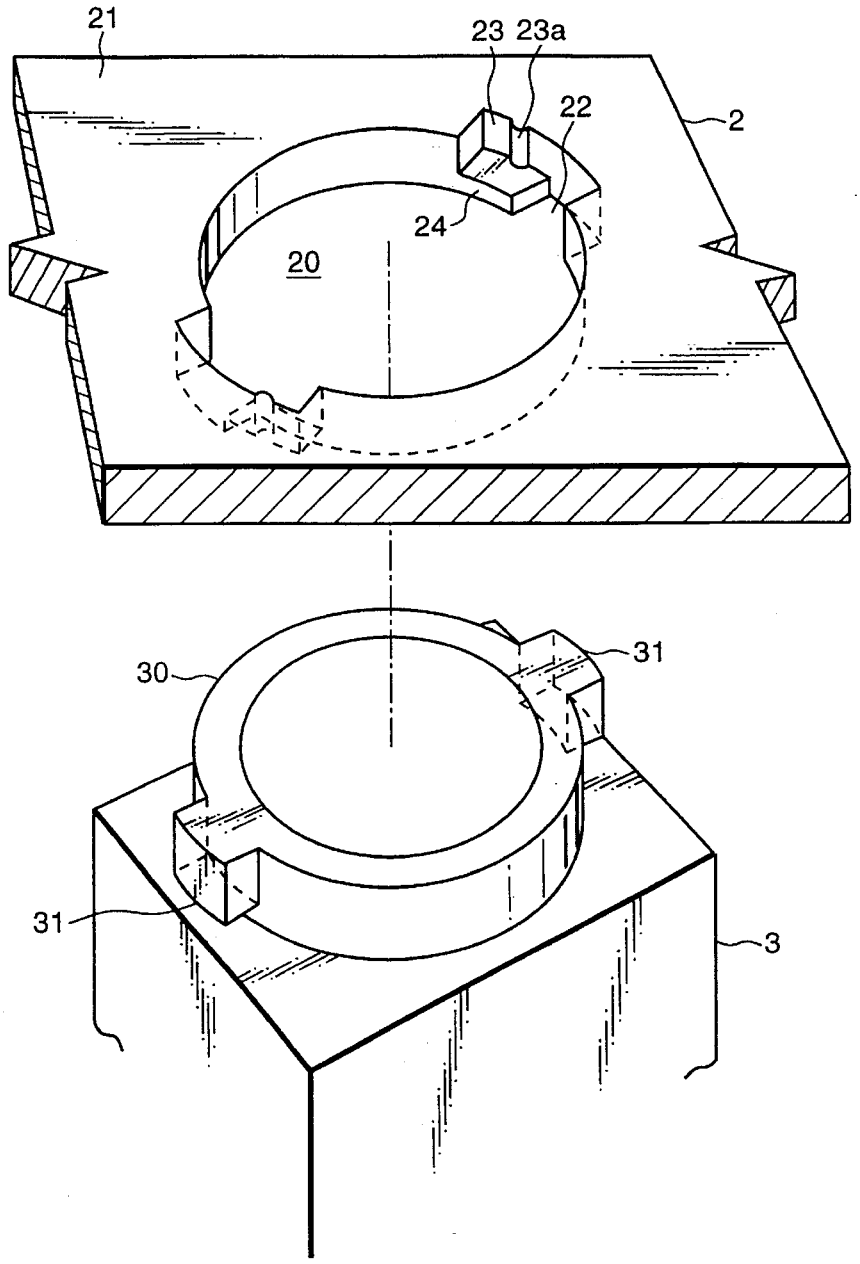
FIG. 1 is a perspective view illustrating an assembling portion of a header and a pipe joint according to an embodiment.
Figure 2:
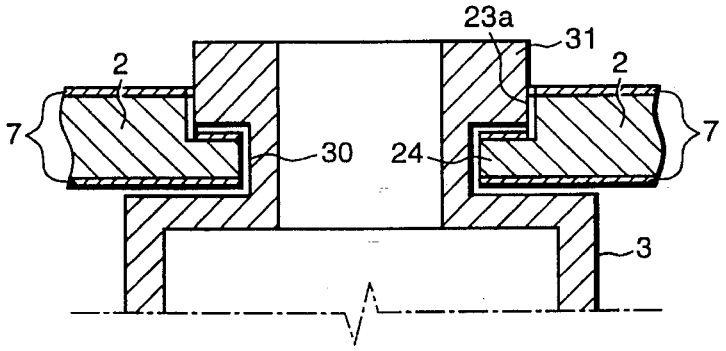
FIG. 2 is a cross-sectional view illustrating a state where the header and the pipe joint are temporarily fixed.

An assembling hole 20 formed on header 2 includes an inserting concave portion 22 and a fitting concave portion 23 in its outer circumference as shown in FIG. 1. Inserting concave portion 22 and fitting concave portion 23 are formed by pressing with assembling hole 20. Inserting concave portion 22 is formed as a rectangular shape so as to be depressed from an inner circumferential surface of assembling hole 20 toward an outer circumferential side. A pair of inserting concave portions 22 are symmetrical with the center line of assembling hole 20.

Fitting concave portion 23 has a thin thickness portion 24 at an outer side of header 2 and is continuously formed with inserting concave portion 22 in a circumferential direction of assembling hole 20. A convex protruding portion 23*a* is provided in an inner surface of fitting concave portion 23. Convex protruding portion 23*a* is formed as a half cylindrical shape and extends inward. Convex portion 23*a* remains as not having been deformed by pressing, when fitting concave portion 23 is formed by pressing. The surface of convex protruding portion 23*a* is therefore an aluminum core material. There are no steps between an inner circumferential surface of fitting concave portion 23 and an inner circumferential surface of inserting concave portion 22, except for convex portion 23*a*, whereby those inner circumferential surfaces are on the same circumference.

Two convex fitting finger portions 31 for position setting are provided on an outer circumferential surface of pipe portion 30 of pipe joint 3. Each finger portion 31 is symmetrical with the other along the center line of pipe portion 30. Finger portions 31 are formed by cutting or forging. Finger portions 31 are not formed over the entire length of pipe portion 30, but are formed on only the tip portion of pipe portion 30, and the undersides of finger portions 31 are spaced from the top end surface of pipe portion 30.

When pipe portion 30 is inserted into assembling hole 20 of header 2, finger portions 31 are inserted into inserting concave portions 22. Pipe joint 3 is turned in an arrow direction shown in FIG. 3, and convex fitting portions 31 are put into fitting concave portions 23.

Figure 3:
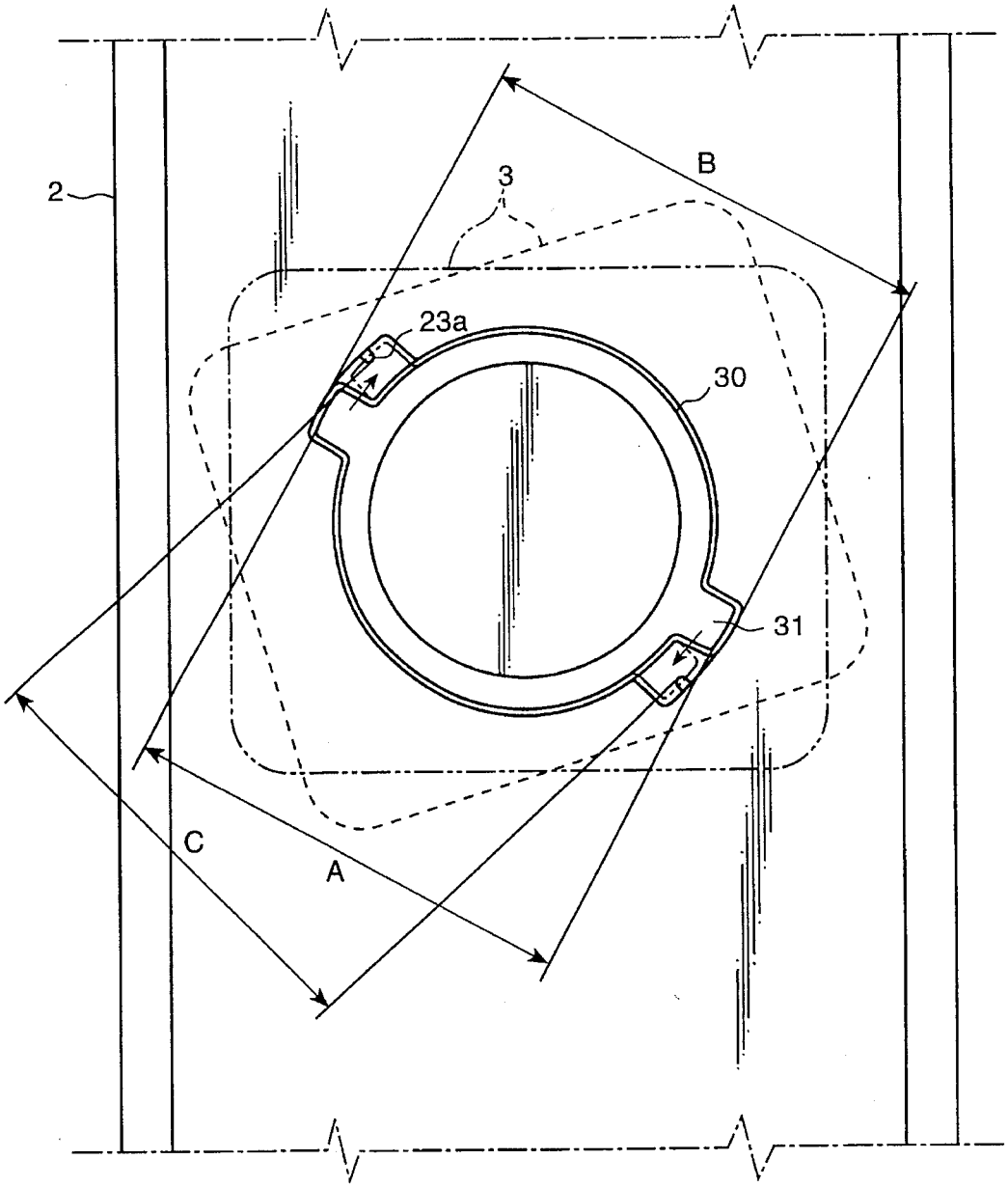
FIG. 3 is a plan view illustrating a state where a pipe portion of the pipe joint is inserted into an assembling hole of the header from the inside of the header.

The two finger portions 31 are formed in a manner that the distance A between outer circumferential surfaces of portion 31 shown in FIG. 3 is slightly smaller than the distance B between inner circumferential surfaces of inserting concave portion 22 and fitting concave portion 23 shown in FIG. 3 (A<B) and is slightly larger than the distance C between convex protruding portions 23*a* of fitting concave portion 23 shown in FIG. 3(C<A). The distance between the end face of pipe joint 3, which abuts an outer surface of header 2, and portion 31 is slightly larger than the thickness of thin thickness portion 24.

Next, a method of assembling header 2 and pipe joint 3 is described.

Firstly, finger portions 31 of pipe joint 3 are fitted into inserting concave portions 22 while pipe portion 30 of pipe joint 3 is inserted into assembling hole 20 of header 2.

Pipe joint 3 is then turned in header 2 in the arrow direction shown in FIG. 3 so that thin thickness portion 24 of header 2 is driven in between the end surface of pipe joint 3 and portion 31.

In this way, each finger portion 31 is pushed or pressed by convex portion 23*a* in fitting concave portion 23 in accordance with the difference of the distance A (the distance between the outer circumferential surfaces of portions 31) and distance C (the distance between the convex protruding portions 23*a*). Finger portions 31 are fixedly positioned by abutting a side face at a side in the turning direction with a side face of fitting concave portion 23 in the turning direction. In this position, thin thickness portion 24 of header 2 is strongly driven in between the end face of pipe joint 3 and extruding portion 31. So, pipe joint 3 is prevented from dropping off from header 2 by thin thickness portion 24. Finger portions 31 contact (press against) convex protruding portions 23*a* directly without intervening brazing material therebetween, because neither the finger portions 31 nor the convex protruding portions 23*a* is covered by brazing material. Because the convex protruding portions 23*a* press against the ends of the finger portions 31 without any brazing material therebetween, they are at least temporarily fixed together without any gap resulting therebetween when the brazing material is molten.

Figure 5:
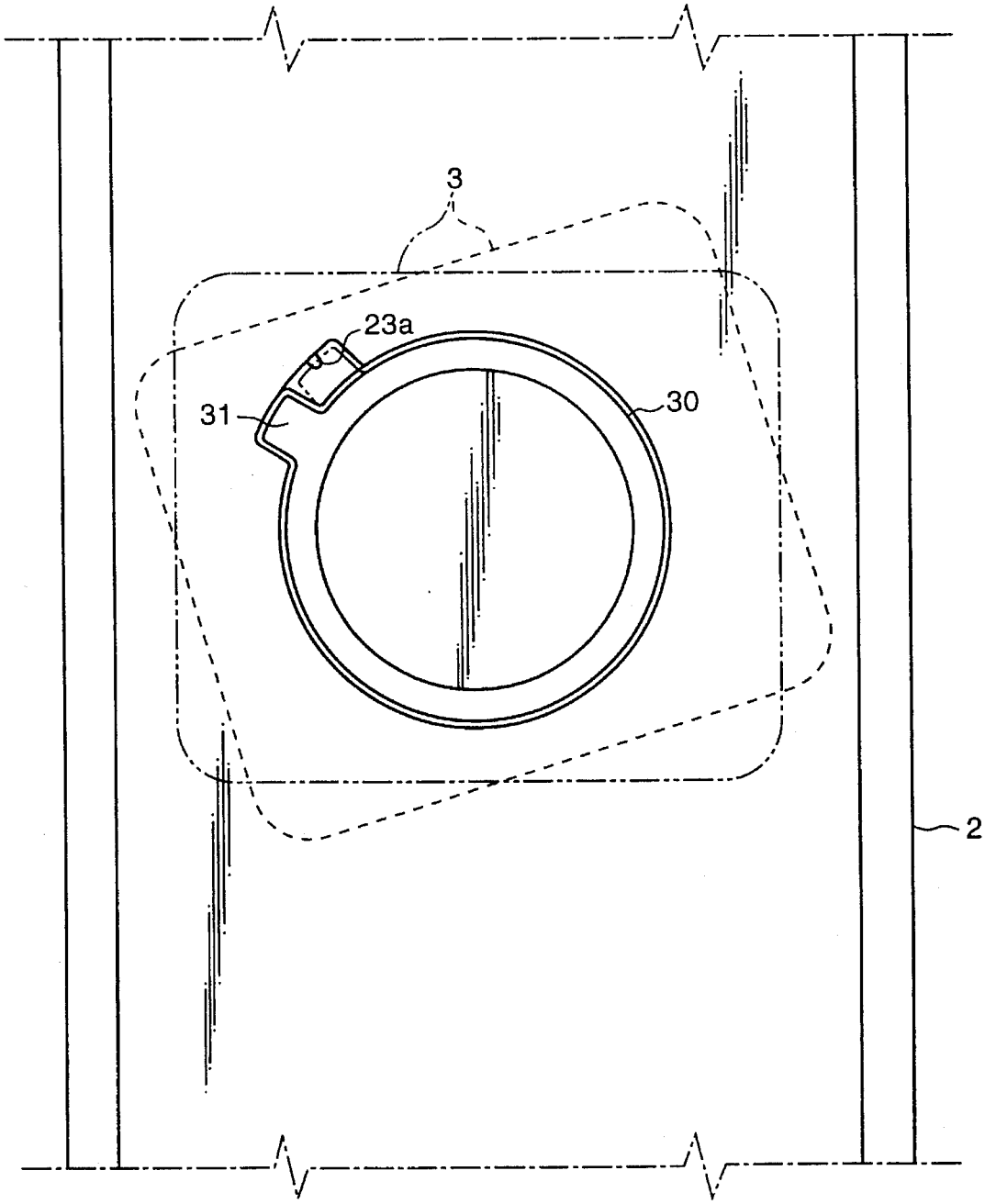
FIG. 5 is a plan view illustrating a modification of the present invention.

The above embodiment can be modified, for example, header 2 and pipe joint 3 are temporarily fixed in a single position as shown in FIG. 5 (or three positions) instead of two positions.

The temporary fixing structure in the embodiment can be applied to a heat exchanger such as a refrigerant evaporator, a refrigerant condenser, a radiator, oil cooler or heater core.

The present invention has been described in connection with what are presently considered to be the most practical and preferred embodiment. However, the invention is not meant to be limited to the disclosed embodiments, but rather is intended to include all modifications and alternative arrangements included within the spirit and scope of the appended claims.

What is claimed is:

1. A heat exchanger comprising:

a first part made of metallic core material and having a first connecting portion; and a second part made of metallic core material and having a second connecting portion which is connected to said first connecting portion;

at least one of said first part and second part being partially covered with a brazing layer, said first connecting portion and said second portion being connected to one another by melting said brazing layer after said first part and said second part are assembled, said first connecting portion including a fitting concave portion, said second connecting portion including a fitting convex portion which is press fitted into said fitting concave portion, and said first connecting portion and said second connecting portion having said metallic core material exposed to opposing surfaces thereof so that each metallic core material directly contacts the other when said fitting convex portion is fitted into said fitting concave portion wherein said fitting concave portion includes a protruding portion which protrudes inwardly from an inner surface of said fitting concave portion, said second part being press fitted into said first part by said protruding portion pressing said fitting convex portion.

2. A heat exchanger according to claim 1, wherein said first part is a header communicating with a passage for heat exchanging fluid, and said second part is a fluid pipe for introducing said fluid into said header or for discharging said fluid out of said header.

3. A heat exchanger according to claim 1, wherein said first part is a header communicating with a passage for heat exchanging fluid, and said second part is a fluid pipe for introducing said fluid into said header or for discharging said fluid out of said header.

4. A heat exchanger according to claim 1, wherein said first part includes a flat plate portion having an assembling hole, said fitting concave portion being formed in an inner circumferential edge of said assembling hole, said second part including a pipe portion having a shape corresponding to said assembling hole, and said fitting convex portion being formed on an outer circumferential surface of said pipe portion.

5. A heat exchanger according to claim 1, wherein said fitting concave portion includes a thin thickness portion extending inward, said thin thickness portion forming one side of said fitting convex portion.

6. A heat exchanger according to claim 1, wherein said fitting convex portion is press fitted into said fitting concave portion by relatively moving said first part and said second part.

7. A heat exchanger according to claim 6, wherein a press fitted direction between said fitting convex portion and said fitting concave portion is different from a relative moving direction of said first part and said second part.

8. A heat exchanger according to claim 7, wherein said press fitted direction is radial and said relative moving direction is circumferential.

9. A connecting structure for connecting first and second parts each made of metallic core material and having respective first and second connecting portions for connection to each other, at least one of said first and second parts being partially covered with a brazing layer, said first connecting portion and said second connecting portion being connected to one another by melting said brazing layer after said first part and said second part are assembled, said connecting structure comprising:

a fitting concave portion formed on said first connecting portion; and a fitting convex portion formed on said second connecting portion which is press fitted into said fitting concave portion;

said first connecting and said second connecting portion having said metallic core material exposed to opposing surfaces thereof so that each metallic core material directly contacts the other when said fitting convex portion is fitted in said fitting concave portion, wherein said fitting concave portion includes a protruding portion which extends inwardly from an inner surface of said fitting concave portion, said second part being press fitted into said first part by said protruding portion pressing said fitting convex portion.

10. A connecting structure according to claim 9, wherein said fitting concave portion includes a thin thickness portion extending inward, said thin thickness portion forming one side of said fitting convex portion.

* * * * *